United States Patent [19]

Schwab

[11] 4,089,202

[45] May 16, 1978

[54] BLIND RIVETER

[75] Inventor: Manfred Schwab, Wiesbaden, Germany

[73] Assignee: Fa Alfred Hansel, Nieten-und Metallwarenfabrik, Ruhr, Germany

[21] Appl. No.: 717,490

[22] Filed: Aug. 25, 1976

[30] Foreign Application Priority Data

Aug. 25, 1975 Germany ..... 2537793

[51] Int. Cl.[2] ..... B21J 15/34

[52] U.S. Cl. ..... 72/391; 72/453.17

[58] Field of Search ..... 72/391, 453.17, 31, 72/32, 35; 81/52.5

[56] References Cited

U.S. PATENT DOCUMENTS

| | | | |
|---|---|---|---|
| 2,303,411 | 12/1942 | Van Horn | 81/52.5 |
| 2,526,956 | 10/1950 | Kugler | 72/411 |
| 3,082,898 | 3/1963 | Bosch | 72/453.17 |
| 3,254,522 | 6/1966 | Elliott | 72/391 |

*Primary Examiner*—C.W. Lanham
*Assistant Examiner*—Gene P. Crosby
*Attorney, Agent, or Firm*—Christie, Parker & Hale

[57] ABSTRACT

A blind riveter comprises a casing, a tension chuck in the casing, means for moving the chuck longitudinally in the casing and a closed hydraulic system for sliding the chuck moving means longitudinally in the casing. In order to determine if the chuck is moving sufficiently in the casing, a view window in the casing and a visible marking on the chuck moving means or the chuck are provided.

18 Claims, 2 Drawing Figures

BLIND RIVETER

BACKGROUND

Figure 1:
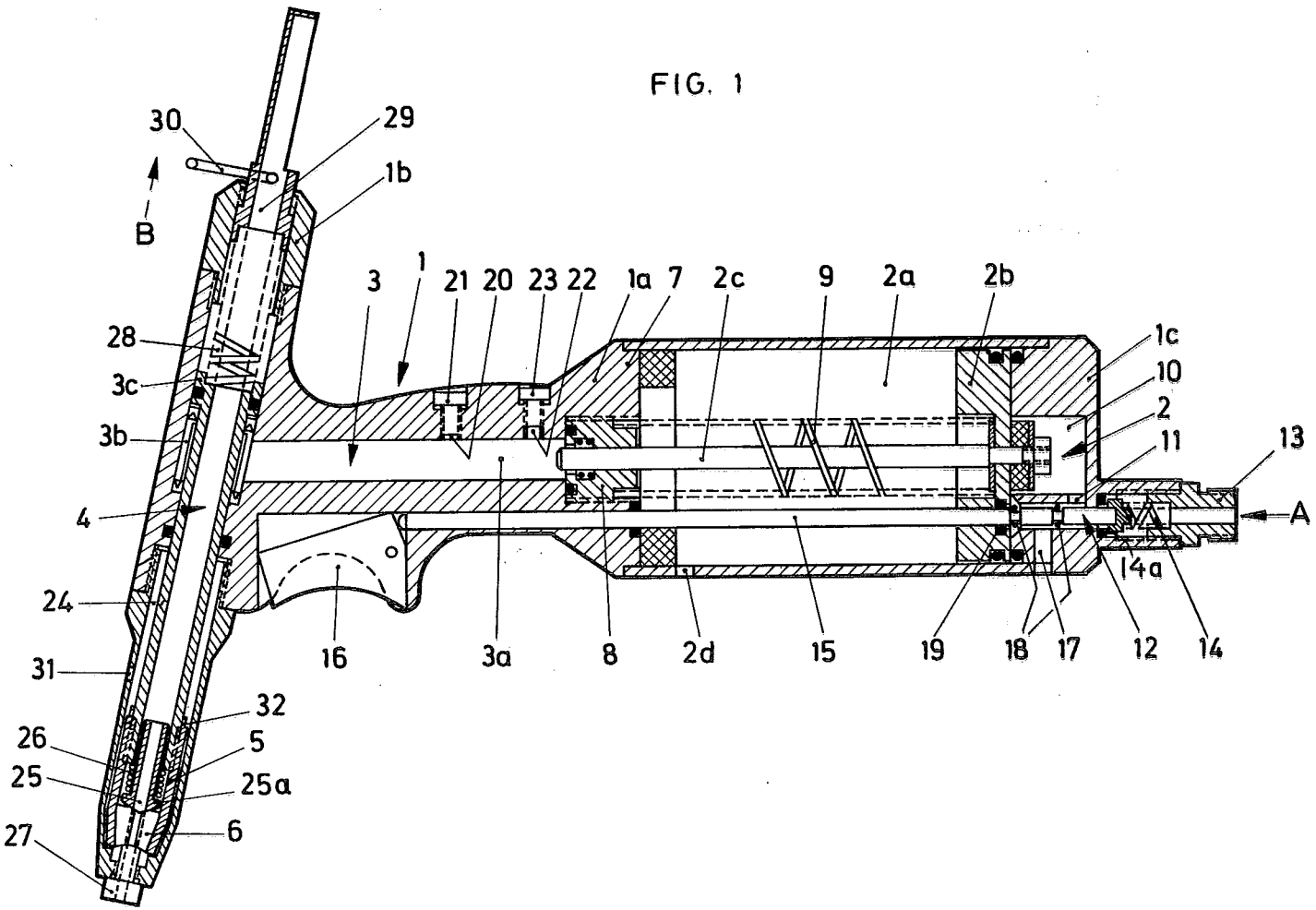

The invention concerns a blind riveter with a chuck arranged in a casing and with a longitudinal sliding mechanism for movement of the chuck, also arranged in the casing, utilizing a closed hydraulic system.

For setting of a perfect rivet, a minimal force and corresponding course for the chuck are absolutely essential. This depends, in a blind riveter of this type, essentially on the pressure buildup in the hydraulic system. The latter changes automatically through the unavoidable loss in leakage. There is a known blind riveter of this type, for which a fill aperture with a lock cap is intended for the control and replenishing of the pneumatic medium. The control necessitates, every time, the opening of the lock cap, therefore time is lost, and filling must be performed in regular intervals in order to ensure the refilling in time. Should the loss due to leakage increase in an unexpected manner between two controls, then the inefficiency in work can only be seen in the result of the work performed. This is however not always an accurate control. Replenishing the contents via the fill aperture must be conducted in a careful manner so that air in the system can completely escape. This again requires considerable time and careful work, whereby the implement must be carefully held in such a manner that the aperture is pointed perfectly up-right.

SUMMARY OF THE INVENTION

The task of the invention is to develop by simple means a blind riveter of the previously described type, so that the contents of the hydraulic system can be checked and without constant manipulation.

The task is accomplished by an indicator installation for detecting a shortcoming in the power strokes.

The indicator installation makes it possible for the operator to immediately recognize any time when the power stroke does not reach its minimal range, which should be reached when the hydraulic system is filled adequately. As long as no indication appears, it is not necessary to open the system. Therefore, the counting of definite intervals of time, or of power strokes, whereafter a filling control must follow, becomes superfluous. The frequency of refilling in a well sealed system is less and should a larger break in the seal occur, the right time for refilling does not become neglected. Furthermore, the indicator installation affords an additional control concerning other elements in the riveter, namely, when opening the hydraulic system and thereby establishing that the contents are still sufficient, i.e., another source would be responsible for an incorrect power stroke.

In the preferred design the indicator system consists of a viewing window in the casing, and a marking on the mechanism for movement, or on the chuck. The marking can be arranged in such a manner that it appears under the regular power stroke in the viewing window across from the casing through the longitudinal motion of the mechanism for movement, whereby the non-appearance would imply an insufficient amount of stroke. More striking is the arrangement in which no marking appears under a sufficient amount of work stroke, and its appearance being evaluated as an alarm signal. The advantage of the latter mentioned arrangement is that merely a small viewing window and small markings are necessary since the relative large range of tolerance of the necessary power stroke need not be made visible. Furthermore, the installation of such a marking and viewing window are relatively inexpensive in the fabrication.

Advantageously, the marking can be put in a ring shape on the mechanism for motion, or on the chuck. This guarantees a visual indicator independent of the installation of the mechanism for movement in relation to the casing, i.e., it saves the consideration during the fabrication concerning the spot where the visual marking is to be arranged. A single perforation in the casing for example, is a louver, placed in the visual field of the operator is sufficient as a viewing window.

The contents of the hydraulic system can be refilled easily and reliably as it has a lockable fill- and similar ventilation aperture. The refilling of the hydraulic medium can be conducted through the filling aperture without any special attention until the same exits a ventilation aperture. Thereby, the use of a funnel for example is possible.

DRAWINGS

Further details of the invention can be taken from the drawings and pertinent description. Shown are:

FIG. 1 a sectional drawing of the blind riveter and

Figure 2:
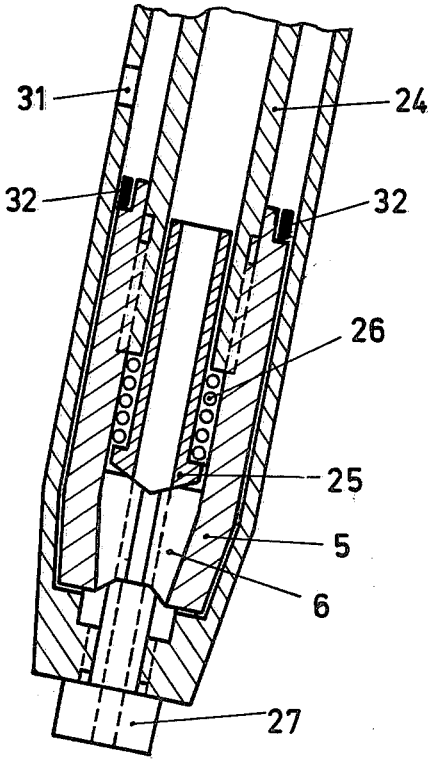

FIG. 2 an enlargement of details.

DESCRIPTION

The blind riveter represented in FIG. 1 has a casing 1 with an operational component 1*a*, and a working component 1*b* which extends almost vertical to the operational component. In the operational component 1*a* is a complete unit accommodated, comprising a pneumatic system designated with 2 and the most essential elements of a hydraulic system designated with 3. The working component 1*b* contains a mechanism for motion 4 for a chuck 5 with chuck jaws 6.

The pneumatic system has cylinder 2*a*, which wall for the most part is constructed from the operational component 1*a* of the casing. A longitudinal sliding piston 2*b* is arranged in cylinder 2*a*. The face of the piston towards the region of the end of the casing is hittable with compressed air. A piston rod 2*c* is attached centrally to the other face of the piston and is axially aligned with the cylinder. The front wall 7 of the cylinder 2*a* opposite the piston is continuous with the casing in one piece and contains centrally a sealing unit 8, wherethrough the piston rod 2*c* penetrates centrally. Its end projects into a hydraulic tube 3*a* which diameter exceeds that of the piston rod 2*c*, which however amounts to less than the diameter of the cylinder 2*a* of the pneumatic system. Further, a coil spring 9 is mounted in the cylinder 2*a* of the pneumatic system which in a resting position loads the piston 2*b* in a direction toward the end of the casing 1*c*, near the end of the cylinder. The casing 1, in its end region 1*c*, forms a chamber 10 with an aperture to the cylinder 2*a*, which is covered by the piston when in its resting position, and with an inlet aperture 11 to a valvular system, which as complete unit is designated with 12. Thereto belongs a connecting piece 13 for a compressed air line not shown, a spring loaded inlet valve 14, a valve tappet 15, which by means of a handle 16 is axially movable against the inlet valve 14 which opens against pressure of its spring, as well as an exit aperture 17 in the end region of the casing 1*c*, and two ring seals 18 working together with the outlet aperture, arranged around the valve tappet with spacing therebetween.

The valve tappet 15 penetrates through the cylinder 2*a* parallel to piston rod 2*c*, whereby one end projects into the valvular system in the described manner, and the other end protrudingly arranged, longitudinally sliding, through the front wall 7 and there butts against the swivelably arranged handle 16. Further, the valve tappet 15 penetrates a sealed sealing ring 19 and the piston 2*b*, whereby the valve tappet and the piston are reciprocally longitudinally slideable.

The hydraulic system 3 has, in the region of the casing 1*a*, a filling aperture 20 opening into the hydraulic tube 3*a* with a lock screw 21 and neighboring thereby a ventilation aperture 22 with a lock screw 23. The ventilation aperture 22 opens in a region of the casing 1 toward the outside, which is slightly thicker than the region where the filling aperture 20 opens.

The hydraulic tube 3*a* opens into a hydraulic cylinder 3*b* which wall essentially belongs to the working component 1*b* of the casing. A ring shaped piston 3*c* is arranged there in a slideable manner. It is connected in one piece together with a tube 24, which on its end farthest from the piston is screwed firmly together with a chuck 5. The chuck 5 conically shaped on its free end, inside and out, encloses chuck jaws 6 which are as well conically designed. A fastener 25 with an essentially tube shaped body is arranged with one end longitudinally slideable in the tube 24, the other end has a rotating conical flange 25*a* on the front side, which pushes against the chuck jaws 6, loaded by the compression spring 26, which props on the reverse side of the flange 25*a*, and again against the front surface of the tube 24. The free ends of chuck jaws 6 are propped against a nozzle 27, which is attached in the casing.

A return spring 28 touches the opposite side of the hydraulic piston 3*c* of the hydraulic cylinder. The other end rests against an abutment 29 which is screwed into the casing 1*b* in a longitudinal adjustable manner. The handle 30 is intended for adjustments.

A viewing window 31 in the configuration of a small opening is intended in the casing 1*b*, roughly in the middle between the working end of the working component 1*b* and the end of the cylinder faced thereto. In the general region of the connection between the chuck 5 and the tube 24 a ring shaped marking 32 in an eye catching color is to be applied to the tube or the chuck. The comprehensive scope of viewing window 31 and marking 32 of the blind riveter is represented in enlarged gauge in FIG. 2.

The mode of operation of the described blind riveter is as follows: The FIG. 1 shows the resting position, in which the air pressure valve 14 is closed by its spring, the piston 2*b* of the pneumatic system is held in position near the end of the casing 1*c* by a coil spring 9, and the piston 3*c* of the hydraulic installation is being pushed in the direction of the working end of the working component 1*b* of the casing by the return spring 28. Depending upon the initial tension of the return spring 28 by the abutment 29, the chuck 5 is pushed over chuck jaws 6 and presses this more or less together. You can in this manner hold an inserted tension shaft of a blind rivet. In such an event, this must be inserted against the strength of the compression spring 26. As the blind rivet is inserted into the intended opening, on which edge the nozzle 27 props, the handle 16 swivels. Thereby, it pressures the valve tappet 15 against the spring loaded inlet valve 14 so that this opens by moving from its valve seat 14*a*.

Compressed air can reach via the direction of arrow A through the inlet aperture 11 into the chamber 10 behind the pneumatic piston 2*b*. With the sliding of the valve tappet 15 both ring seals 18 arrive at the position on both sides of the exit aperture 17, so that the compressed air of chamber 10 cannot reach the outlet aperture. It pushes the piston 2*b*, on the contrary, against the force of the coil spring 9 in such a manner that the piston rod 2*c* plunges into the hydraulic tube 3*a*. In this manner, the pressure in the closed hydraulic system 3 increases. Through the increased pressure, the ring piston 3*c* is pushed against the return spring 28 in the direction of the arrow B. Automatically, tube 24 transfers this motion to the chuck 5. This on one hand takes the chuck jaws 6 with it, whereby the action of the conical surfaces together compresses even more, since chuck jaws cannot follow immediately due to the friction of motion with the tension shaft of a blind rivet. By the further course of the piston stroke the chuck jaws are carried along and transfer the tension to the tension shaft which on the other hand in the known manner, deforms the rivet head and finally tears away at the intended breaking off site. The torn off shaft end can reach the outside of the casing of the implement through the axially aligned bore holes of the chuck jaws, of the fasteners, of the tube 24 and finally as well of the tube shaped abutment 29. As soon as the person operating the implement perceives the jolt under the tearing off of the tension shaft and releases the handle 16, valve 14 closes by its spring, during which the valve tappet moves back to the starting position. Thereby, air can pass through an outlet aperture 2*d* into the cylinder directly from the outside, and compressed air can pass out of chamber 10, which has become larger through the stroke of the piston, sideways around the protruding portion of the valve tappet in this chamber to flow outside the outlet aperture 17. Piston 2*b* is moved to its resting position by coil spring 9. Simultaneously with the reduction of pressure in the hydraulic tube 3*a*, the return spring 28 moves the piston 3*c* back into the starting position.

The viewing window 31 and the marking 32 are arranged in the working component 1*b* of the casing in such a manner that the axial distance in the resting position corresponds to a theoretical established work stroke as minimal limit. During the normal work stroke the marking therefore passes by the viewing window 31 completely out of sight. As soon as the pressure buildup in the hydraulic system is reduced, due to a loss in leaks etc., to the extent to be only efficient enough to maintain the established work stroke, the marking in viewing window 31 remains visual during the process of work. This is an indication for the person operating the implement, that the hydraulic medium must be replenished. For replenishing hydraulic system 3 the lock screws 21 and 23 of the fill- and ventilation apertures have to be unscrewed. Hydraulic medium is to be filled through the filling aperture until it runs out of the slightly higher opening of the ventilation aperture. Thereby, it is guaranteed that no remaining air will be found in the hydraulic system. The lock screws can be reinserted.

The invention is not limited to the example in the design. Instead of alarm signal indicating insufficient stroke, there can also be provided a regularly appearing marking indicating adequate stroke which marking ceases to appear if the stroke becomes inadequate. In place of a color marking, an indicator can as well be in the form of a peg sliding in a louver, or something similar. In place of a single viewing window 31, several thereof can be arranged at the same level in the circumference of the casing so that the person operating the implement can recognize the marking in all visual directions in relation to the implement.

I claim:

1. In a blind riveter comprising a casing, a tension chuck in the casing, means for moving the tension chuck longitudinally in the casing, and a closed hydraulic system for sliding the chuck moving means longitudinally in the casing, the improvement comprising a visible marking on the chuck moving means and a viewing window in the casing for viewing the marking, said marking being arranged when visible through the viewing window to indicate insufficient longitudinal movement of the chuck in the casing.

2. The blind riveter of claim 1 in which the visible marking is arranged in a ring around the chuck moving means.

3. The blind riveter of claim 2 comprising in addition a closable fill aperture and a closable vent aperture for the hydraulic system, both apertures having an inlet on the exterior of the casing.

4. The blind riveter of claim 3 in which the inlet of the ventilation aperture is higher than the inlet of the filling aperture.

5. The blind riveter of claim 1 comprising in addition a closable fill aperture and a closable vent aperture for the hydraulic system, both openings having an inlet on the exterior of the casing.

6. The blind riveter of claim 5 in which the inlet of the ventilation aperture is higher than the inlet of the filling aperture.

7. In a blind riveter comprising a casing, a tension chuck in a working component of the casing, means for moving the tension chuck longitudinally in the working component of the casing, and a closed hydraulic system for sliding the chuck moving means longitudinally in the working component of the casing, the improvement comprising a visible marking on the chuck and a viewing window in the side wall of the working component of the casing for viewing the marking during the process of work to indicate insufficient longitudinal movement of the chuck in the working component of the casing.

8. The blind riveter of claim 7 in which the visible marking is arranged in a ring around the chuck.

9. The blind riveter of claim 8 comprising in addition a closable fill aperture and a closable vent aperture for the hydraulic system, both apertures having an inlet on the exterior of the casing.

10. The blind riveter of claim 9 in which the inlet of the ventilation aperture is higher than the inlet of the filling aperture.

11. The blind riveter of claim 7 comprising in addition a closable fill aperture and a closable vent aperture for the hydraulic system, both openings having an inlet on the exterior of the casing.

12. The blind riveter of claim 11 in which the inlet of the ventilation aperture is higher than the inlet of the filling aperture.

13. In a blind riveter comprising a casing, a tension chuck in the casing, means for moving the tension chuck longitudinally in the casing, and a closed hydraulic system for sliding the chuck moving means longitudinally in the casing, the improvement comprising a visible marking on the chuck moving means and a viewing window in the casing for viewing the marking, said marking being arranged so that it is normally visible through the viewing window when the chuck moving means slides in the casing, wherein when the marking is not visible insufficient longitudinal movement of the chuck in the casing is indicated.

14. The blind riveter of claim 13 in which the visible marking is arranged in a ring around the chuck moving means.

15. The blind riveter of claim 14 comprising in addition a closable fill aperture and a closable vent aperture for the hydraulic system, both apertures having an inlet on the exterior of the casing.

16. The blind riveter of claim 15 in which the inlet of the ventilation aperture is higher than the inlet of the filling aperture.

17. The blind riveter of claim 13 comprising in addition a closable fill aperture and a closable vent aperture for the hydraulic system, both openings having an inlet on the exterior of the casing.

18. The blind riveter of claim 17 in which the inlet of the ventilation aperture is higher than the inlet of the filling aperture.

* * * * *